US007055605B2

(12) United States Patent
Howlett et al.

(10) Patent No.: US 7,055,605 B2
(45) Date of Patent: Jun. 6, 2006

(54) DOWNHOLE CIRCULATION VALVE OPERATED BY DROPPING BALLS

(75) Inventors: Paul David Howlett, Aberdeen (GB); George Telfer, Aberdeen (GB)

(73) Assignee: Specialised Petroleum Services Group Ltd., Westhill (GB)

( * ) Notice: Subject to any disclaimer, the term of this patent is extended or adjusted under 35 U.S.C. 154(b) by 157 days.

(21) Appl. No.: 10/467,135

(22) PCT Filed: Jan. 11, 2002

(86) PCT No.: PCT/GB02/00083

§ 371 (c)(1),
(2), (4) Date: Jan. 5, 2004

(87) PCT Pub. No.: WO02/061236

PCT Pub. Date: Aug. 8, 2002

(65) Prior Publication Data

US 2004/0099447 A1 May 27, 2004

(30) Foreign Application Priority Data

Jan. 31, 2001 (GB) ..... 0102485.0

(51) Int. Cl.
*E21B 34/14* (2006.01)

(52) U.S. Cl. ..... 166/318; 166/317; 166/386

(58) Field of Classification Search ..... 166/317, 166/318, 334.4, 386; 175/268
See application file for complete search history.

(56) References Cited

U.S. PATENT DOCUMENTS

| | | | | |
|---|---|---|---|---|
| 3,054,415 | A * | 9/1962 | Baker et al. | 137/68.16 |
| 5,499,487 | A * | 3/1996 | McGill | 53/473 |
| 5,499,687 | A | 3/1996 | Lee | |
| 5,533,571 | A | 7/1996 | Surjaatmadja et al. | |

FOREIGN PATENT DOCUMENTS

| | | |
|---|---|---|
| GB | 2268770 | 1/1994 |
| GB | 2341405 | 3/2000 |
| WO | WO/2001/90529 | 11/2001 |

* cited by examiner

*Primary Examiner*—David Bagnell
*Assistant Examiner*—Giovanna M. Collins
(74) *Attorney, Agent, or Firm*—C. Dean Dominque; Robert L. Waddell; Ted A. Anthony

(57) ABSTRACT

A downhole tool (10) for selectively circulating fluid in a borehole is disclosed. The tool operates via the use of a combination of deformable drop balls (36) and smaller hard drop balls (40). In use a deformable drop ball (36) moves a sleeve (20) exposing a radial port (30,32) to provide fluid circulation radially from the tool. The smaller drop ball (40) can then obstruct the radial port (32,30) and by the increased pressure the deformable drop ball (36) is extruded through the tool. The resulting pressure differential as the drop ball (36) moves causes the sleeve (20) to rise, releasing the smaller drop (40) ball and closing the radial port (32,30). The process can be repeated to selectively circulate fluid through the tool.

15 Claims, 5 Drawing Sheets

DOWNHOLE CIRCULATION VALVE OPERATED BY DROPPING BALLS

Figure 1:
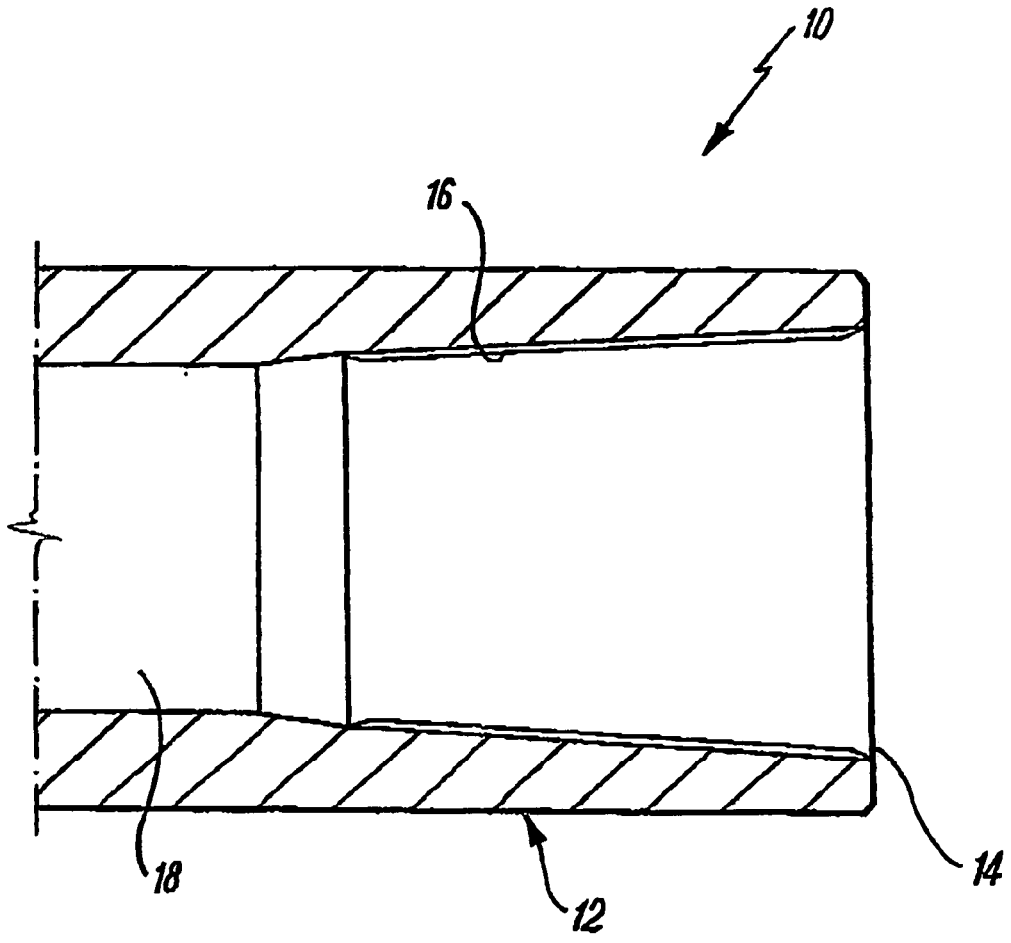

This patent application claims an international filing date of 11 Jan. 2002 and a priority date of 31 Jan. 2001. This invention relates to apparatus and method for circulating fluid in a borehole.

It is known that this operation can be achieved by employing a downhole tool connected on a drill string. The tool includes means for circulating fluid through the length of the drill string and also redirecting the fluid at higher flow rates out of the drill string onto the walls of the borehole.

Such tools are of at least two generic types. One type of tool is a weight-set tool. Such a tool comprises a tubular assembly connected to the drill string and includes a general axial fluid outlet, a generally transversed fluid outlet and an obturating member which is moveable between a first position and a second position at which the transverse fluid outlet is open. The obturating member is moved relative to the tubular assembly by extending or collapsing the tool, the latter movement occurring by causing a shoulder coupled to the obturating member to engage with a formation in the borehole. Such tools have the disadvantage that they require contact to a formation within the borehole, thus a ledge or formation must exist within the borehole.

A second type of circulation tool utilises the well known practice of dropping spherical balls or darts down the drill string to open or close valves, thereby alternating the circulation paths of fluid. The main disadvantage of these tools is that it is difficult to control both axial and radial fluid flow from a single spherical ball. There is also known difficulties in achieving release of the ball so that axial fluid may be established through the drill string.

An object of the present invention is to provide an improved downhole tool for fluid circulation, which obviates or at least mitigates some of the disadvantages of the prior art.

A further object of the present invention is to provide an improved downhole tool for fluid circulation which can be repeatably operated downhole.

A yet further object of the present invention is to provide an improved downhole tool for fluid circulation which is operated by fluid pressure and does not require the incorporation of springs.

According to a first aspect of the present invention there is provided a downhole tool for circulating fluid within a borehole, the tool comprising:

a tubular assembly having an axial through passage between an inlet and a first outlet, a second outlet extending generally transversely from the tubular assembly and the through passage including a lower ball retaining means;

an obturating member including an upper ball retaining means, the obturating member being moveable relative to the tubular assembly between a first position closing the second outlet and a second position at which the second outlet is open; and first ball means being retainable within said upper and said lower ball retaining means to prevent fluid flow between the inlet and first outlet and the first ball means being deformable under increased fluid pressure to pass through said upper and said lower ball retaining means.

Preferably the tool further includes second ball means wherein the second ball means is of a size which when located in the second outlet prevents fluid flow therethrough.

Preferably the ball means is a spherical drop ball. More preferably the first ball means has a larger diameter than the second ball means.

Preferably also the first ball means is made from an extrudable material, such as a plastic or phenolic material.

Preferably the second ball means is made from a hard material, such as steel or the like.

Preferably the upper and lower ball retaining means is a generally circular shoulder or ledge. Thus the first ball means seats on the ball retaining means preventing fluid flow between the inlet and first outlet. When fluid pressure increases the first ball means is extruded by deforming through the ball retaining means.

Preferably the obturating member is a sleeve. More preferably the sleeve includes a radial port.

Additionally the sleeve may be coupled to a collet. The collet allows the sleeve to be releasably engaged to the tubular assembly. The collet also allows the radial port to remain aligned with the second outlet by preventing the sleeve from turning within the tubular assembly.

Preferably the tool further includes catching means for catching the ball means once they have passed through the ball retaining means. Such a catching means allows the balls to be collected and returned from the well once the tool has finished its operations.

According to a further aspect of the present invention, there is provided a method of circulating fluid in a borehole comprising the steps of:

(a) connecting a downhole tool, according to the first aspect of the present invention, in a drill string suspended in the borehole;

(b) establishing fluid flow through the axial through passage of the tool;

(c) releasing the first ball means into the axial through passage to seat in the upper ball retaining means thereby obstructing the axial fluid flow through the tool;

(d) moving the obturating member by the increase of fluid pressure against the first ball means to locate the radial port with the second outlet thereby allowing fluid flow through the second outlet;

(e) releasing the second ball means from the surface, such that the second ball means locates in the radial port thereby obstructing the fluid flow through the second outlet;

(f) forcing the first ball means passed the upper ball retaining means by the increase in pressure so as to locate the first ball means in the lower ball retaining means, the first ball means falling a distance comparatively short enough to ensure sufficient pressure to move the obturating member back up the tubular assembly thereby closing the radial port and releasing the second ball means; and (g) allowing the fluid pressure to increase to a sufficient pressure to cause the first ball means to pass through the lower ball retaining means and the second ball means to follow therethrough and allow axial fluid flow to be re-established.

Preferably the method also includes catching the ball means in a catching means at the bottom of the tool.

An advantage of the method of the present invention is that the steps may be repeated any number of times to provide circulation of fluid through the tool.

Figure 3:
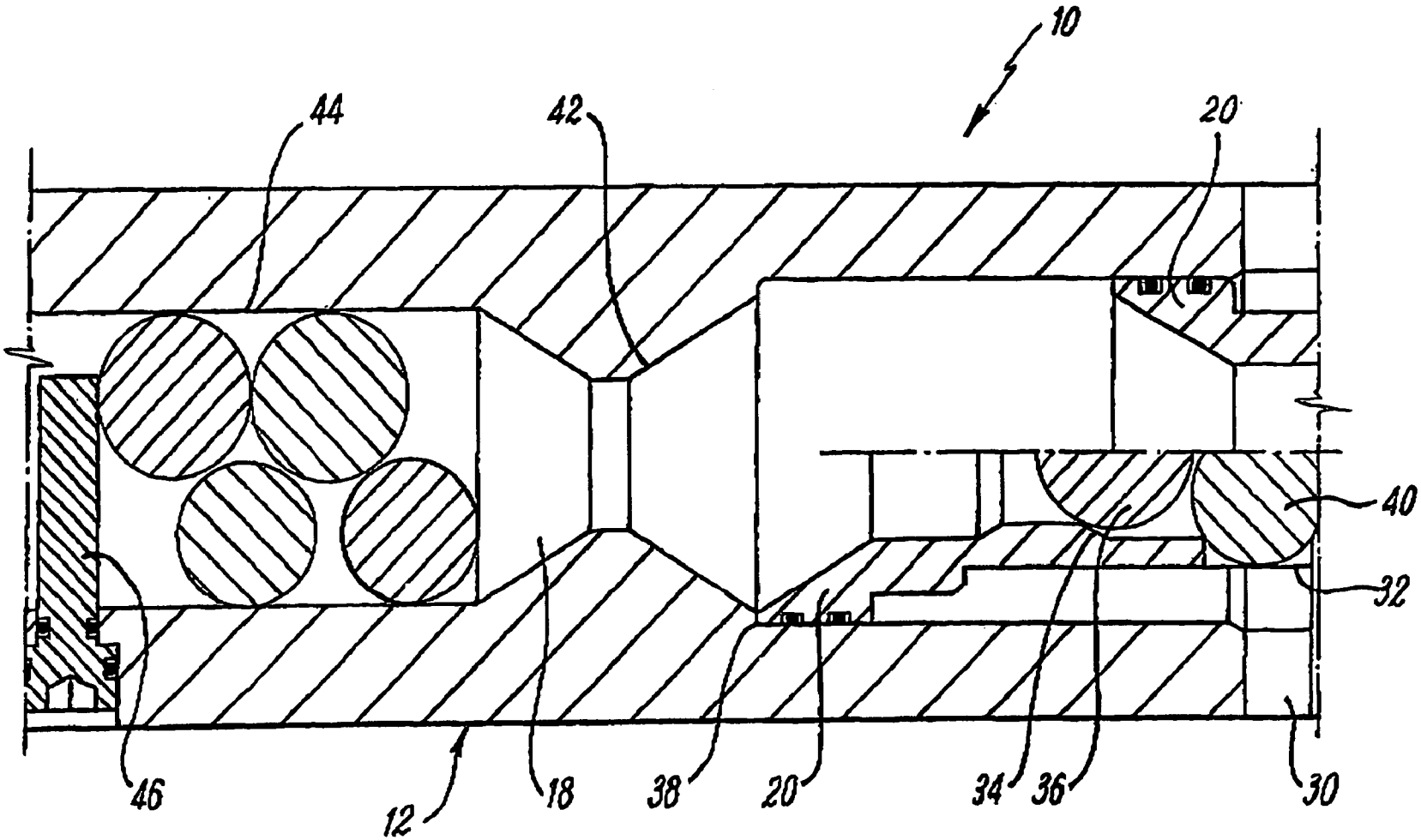
Figure 4:
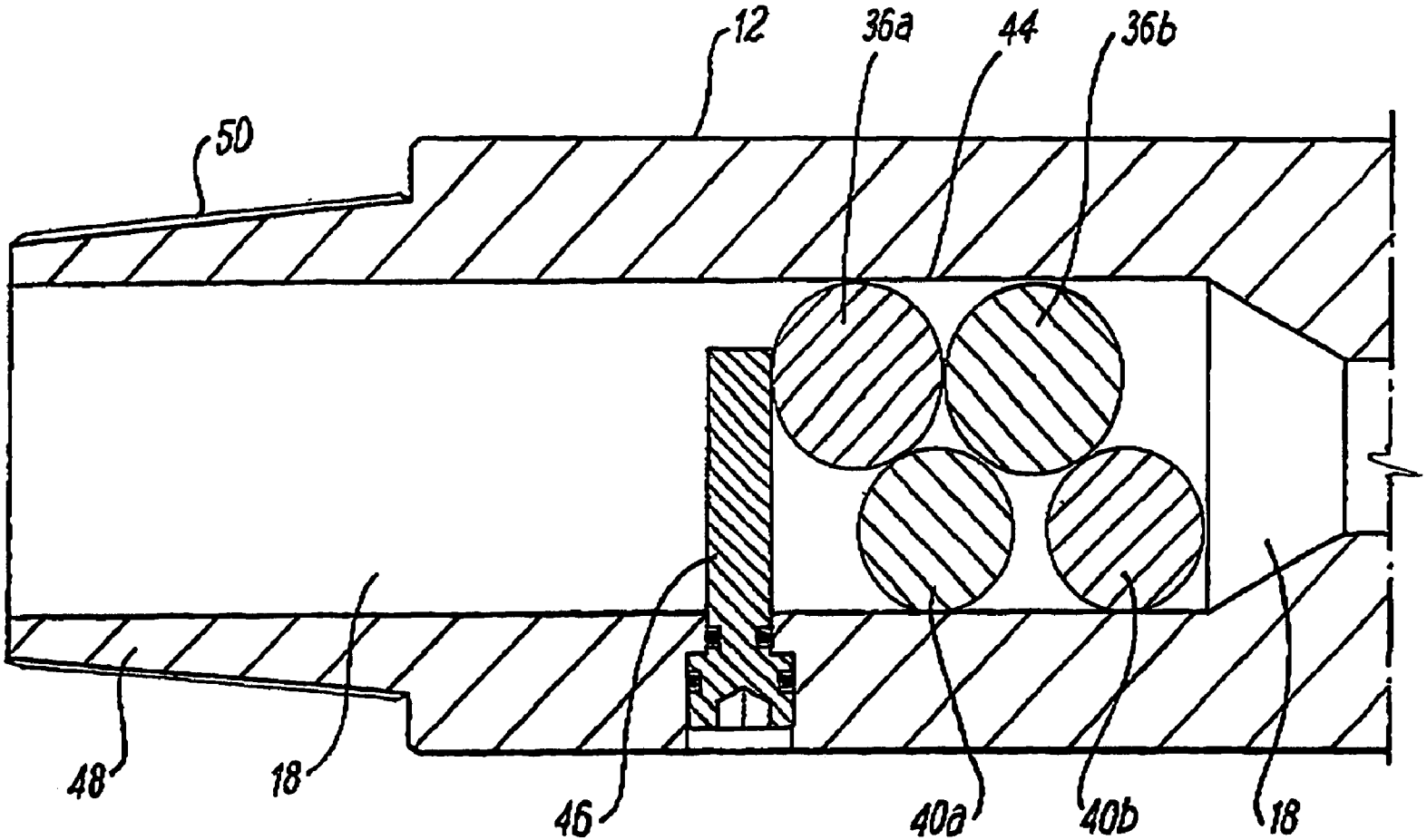
Figure 5:
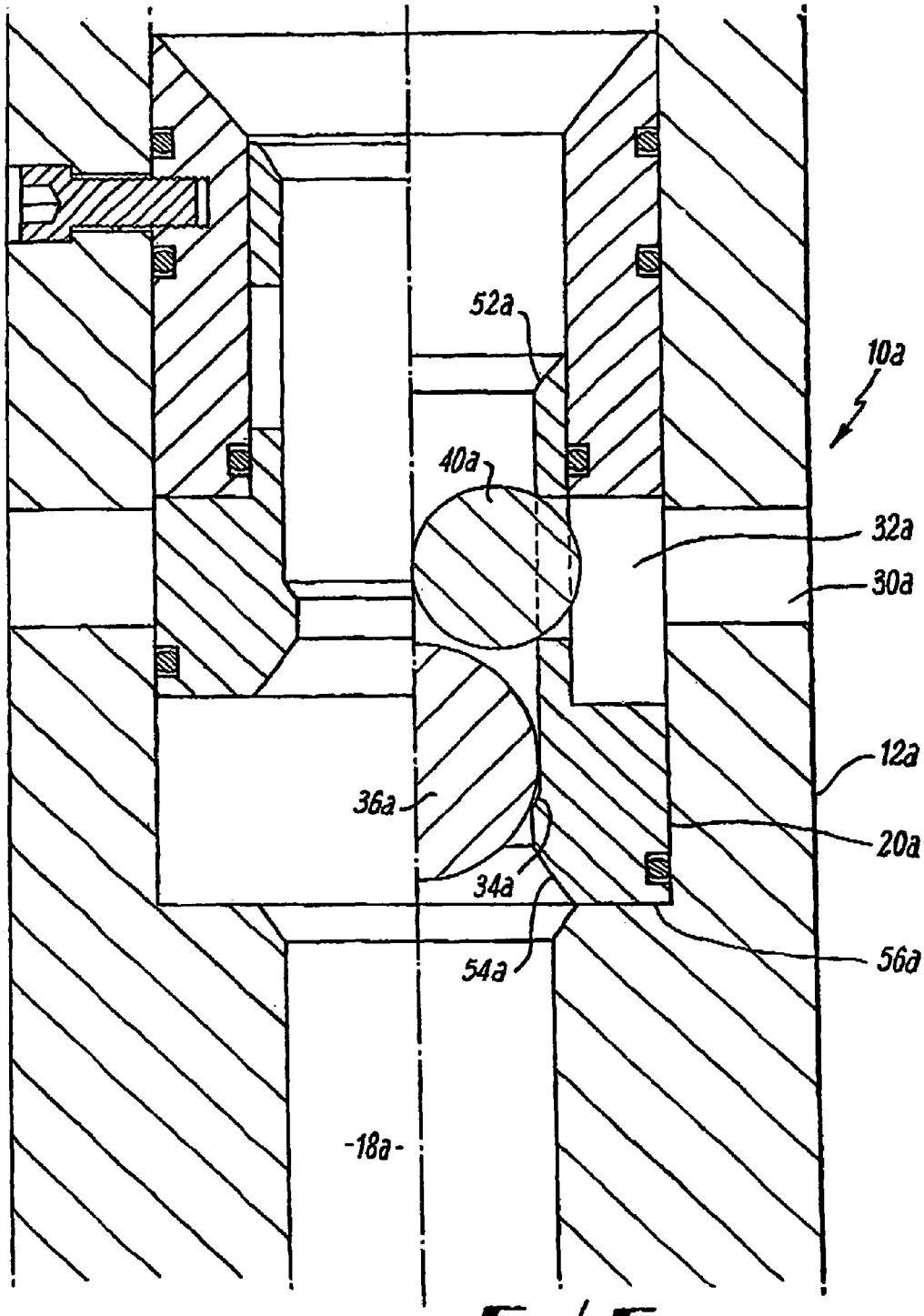

In order to provide a better understanding of the invention, embodiments will now be described, by way of example only, with reference to the following Figures, in which:

FIGS. 1 through 4 are sequential part cross-sectional views through a downhole tool according to a first embodiment of the present invention; and FIG. 5 is a part cross-sectional view through a downhole tool according to a second embodiment of the present invention.

Referring initially to FIG. 1, there is a shown a top section of a downhole tool, termed a circulating tool and generally referred to by reference numeral 10, according to a first embodiment of the present invention. The circulating tool 10 comprises a tubular assembly 12 having a first end 14 including a screw thread connection 16 to connect the circulating tool 10 to a drill string (not shown). Tubular assembly 12 includes an axial through passage 18. When located in a borehole the tool section shown in FIG. 1 is closest to the surface.

Figure 2:
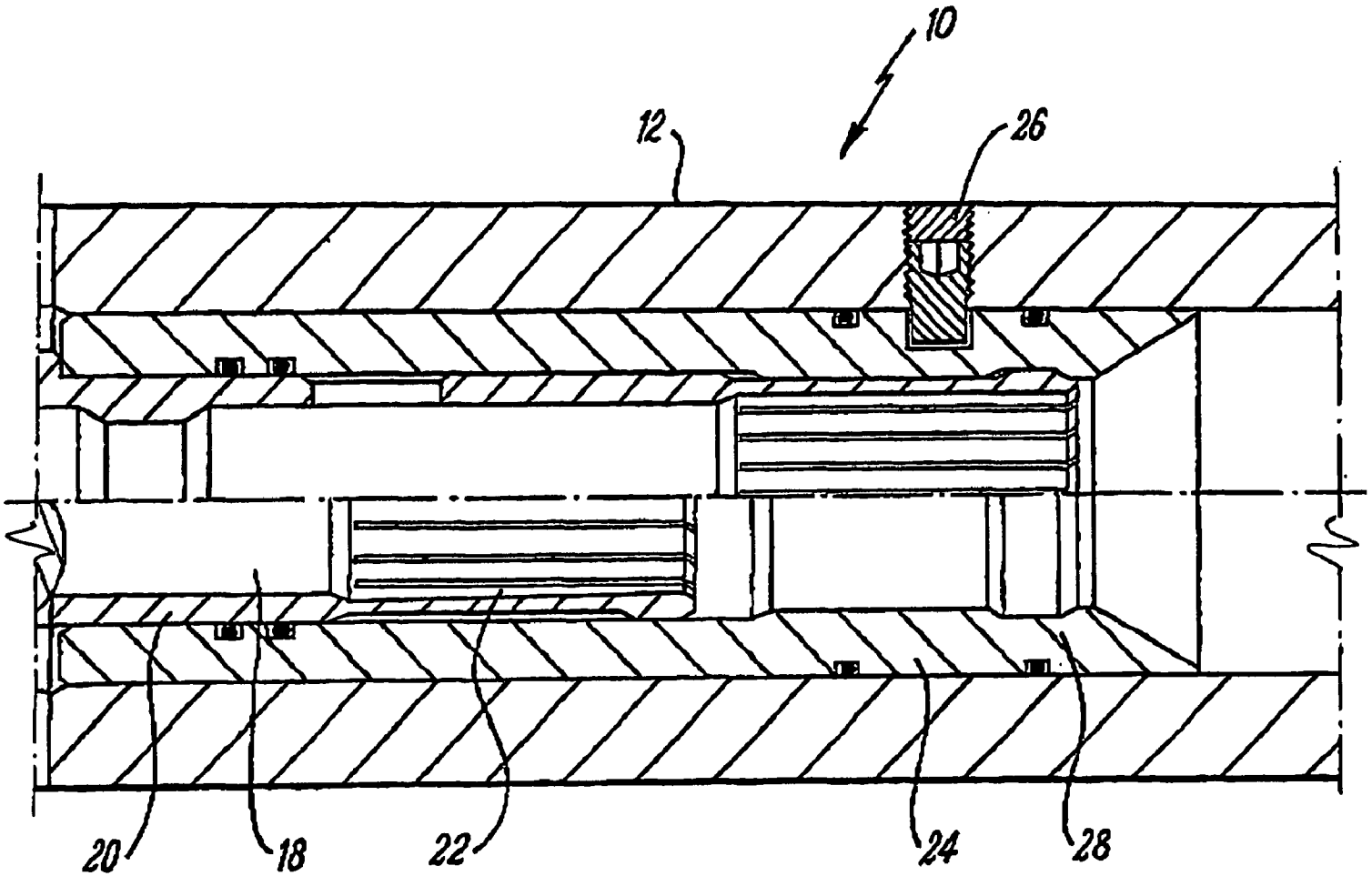

Reference is now made to FIG. 2 of the drawings which depicts a further section of the circulating tool 10 in a downward direction from the surface. Inside tubular assembly 12 is located the obturating member 20 in the form of a sleeve 20. Sleeve 20 is coupled to a collet 22 which is slidable against an inner sleeve 24 of the tubular assembly 12. Inner sleeve 24 is held in place by a retaining pin or grub screw 26. Collet 22 can move longitudinally against inner sleeve 24, and can releasably engage in circular recess 28. Sleeve 20, inner sleeve 24 and the outer wall of the tubular assembly 12 are each provided with sealing means in the form of o-rings to prevent the ingress of fluid therebetween.

Reference is now made to FIG. 3 of the drawings which depicts a further section of the circulation tool 10. In this embodiment sleeve 20 includes port 32 which when sleeve 20 is in an open position aligns with a radial port 30 in the tubular assembly 12. In this open position sleeve 20 is located against shoulder 38 of tubular assembly 12. A first spherical ball 36 is located against a shoulder 34 of the sleeve 20 which retains the ball 36 as fluid flows via ports 30 and 32. A second spherical ball 40 is shown located in post 30 thereby closing the fluid flow radially from the tool 10. It will be apparent that when collet 22 is located in recess 28 the sleeve 20 is in the closed position, obturating the outlet port 30.

In tubular assembly 12 there is also located seat 42 which is of a diameter sufficient to retain ball 36. When ball 36 is extruded through seat 42 it is caught in catcher 44 and prevented from flowing through the drill string by the peg 46. Ball 40 can pass cleanly through seats 34,42 and will come to rest in the ball catcher 44.

Reference is now made to FIG. 4 of the drawings which illustrates ball catcher 44 including balls 36*a,b* and 40*a,b*. It will be appreciated that the location of pin 46 will determine how many balls may be retained in the ball catcher 44. The location of the balls 36*a,b* 40*a,b* does not obstruct fluid flow through axial through passage 18 and out of first outlet 48. Outlet 48 includes connection means 50 in the form of a screw thread for connecting the circulation tool 10 to a further downhole drill string (not shown).

In use, tool 10 is attached in a drill string with the sleeve 20 held in the closed position which obturates outlet port 30. The sleeve 20 is held in this closed position by the location of collet 22 in recess 28.

To operate the tool 10, ball 36 is dropped down the axial through passage in the fluid flow and comes to rest against shoulder 34. Ball 36 seals against shoulder 34 and blocks fluid flow through the tool 10. The fluid pressure pushes ball 36 and consequently sleeve 20 in the axial direction of fluid flow through passage 18. Sleeve comes to rest against shoulder 38 and radial port 32 is aligned with the outlet port 30. Fluid flow is now radially from the tool via port 30. This radial flow can be of high pressure as the port 30 may be of a small diameter or be shaped as a jet (not shown).

When the radial fluid flow is required to be stopped a second ball 40 is dropped into the passage 18 at the surface. Ball 40 is carried in the fluid and forced against port 32 thereby sealing the radial port 30. Ball 40 is made of steel to withstand the downhole pressure exerted upon it. However, the consequential increase in fluid pressure in the passage 18 causes ball 36, which is made of a deformable plastic, to be extruded through the seat 34. Ball 36 is then forced against lower seat 42 and because the distance between the seats 34 and 42 is relatively small, i.e. approximately 6 inches for ball diameters of 2 inches and 1.75 inches and inner passage diameter of 3.75 inches, the resulting pressure differential at the base of the sleeve 20 causes the sleeve 20 to move upwards to the closed position. As the sleeve 20 moves upwards ball 40 is released into the axial fluid flow and falls through seat 34.

With radial port 30 now closed, all fluid pressure is substantially against ball 36 and the ball 36 is extruded by deforming through the seat 42 and falls into the ball catcher 44. Ball 36 is held within the ball catcher 44 be the retaining pin 46. Ball 40 falls through seat 42 and is also held within the ball catcher 44.

If radial flow is required again the above procedure may be repeated without the need for removing the tool 10 from the borehole. This procedure may be repeated until the ball catcher is full whereby the tool is returned to the surface for the catcher 44 to be emptied.

Reference is now made to FIG. 5 of the drawings which depicts a section of the circulation tool 10*a* in accordance with a second embodiment of the present invention. Like parts to those of FIGS. 1 to 4 have been given the same numerals but are suffixed "a". Tool 10*a* works in an identical fashion to tool 10 except that collet 22 has been removed. In the second embodiment, sleeve 20*a* is arranged such that surface 52 is smaller than surfaces 54 and 56 which ensures that sleeve 20*a* moves up to and remains in the closed position without the need of the collet 22.

The principal advantage of the present invention is that it may be operated solely by hydraulic pressure of the fluid within the borehole, the tool requires no springs or locking/engaging means to move the obturating member. A further advantage of the present invention is that circulation of the fluid can be selectively started and stopped any of number of times and is only dependent on the available space in the ball catcher mechanism at the base of the tool is used. Thus this removes the need for shearing mechanisms found in other fluid circulating tools.

It will be appreciated by those skilled in the art that various modifications may be made to the present invention without departing from the scope thereof. For example the ball means could equally be darts or any other shaped objects which will travel through the fluid and locate in the ball retaining means.

The invention claimed is:

1. A downhole tool for circulating fluid within a borehole, the tool comprising:

a tubular assembly having an axial through passage between an inlet and a first outlet, a second outlet extending generally transversely from the tubular assembly and the through passage including a lower ball retaining means;

an obturating member including an upper ball retaining means, the obturating member being moveable relative to the tubular assembly between a first position closing the second outlet and a second position at which the second outlet is open; and first ball means being retainable within said upper and said lower ball retaining means, the first ball means preventing fluid flow between the inlet and first outlet when retained within said upper ball retaining means and when retained within said lower ball retaining means, the first ball means being deformable under fluid pressure above a first pressure to pass through said upper and said lower ball retaining means.

2. A downhole tool as claimed in claim 1 wherein the tool further includes second ball means wherein the second ball means is of a size which when located in the second outlet prevents fluid flow therethrough.

3. A downhole tool as claimed in claim 2 wherein the first ball means has a larger diameter than the second ball means.

4. A downhole tool as claimed in claim 2 wherein the second ball means is made from a hard material, which is not deformable.

5. A downhole tool as claimed in claim 2 wherein the tool further includes catching means for catching the first and second ball means once they have passed through the upper and lower ball retaining means.

6. A downhole tool as claimed in claim 1 wherein the ball means is a spherical drop ball.

7. A downhole tool as claimed in claim 1 wherein also the first ball means is made from an extrudable material, which is deformable under a pressure above the first pressure.

8. A downhole tool as claimed in claim 1 wherein the upper and lower ball retaining means are substantially circular shoulders arranged so that the first ball means seats on the upper and lower ball retaining means preventing fluid flow between the inlet and first outlet until the first pressure is reached whereupon the first ball means is extruded by deforming through the respective ball retaining means.

9. A downhole tool as claimed in claim 1 wherein the obturating member is a sleeve.

10. A downhole tool as claimed in claim 9 wherein the sleeve includes a radial port.

11. A downhole tool as claimed in claim 1 wherein the obturating member is coupled to a collet so that it is releasably engaged to the tubular assembly.

12. A downhole tool as claimed in claim 11, wherein the obturating member is a sleeve including a radial port, and wherein the radial port remains aligned with the second outlet by virtue of the collet.

13. A method of circulating fluid in a borehole, comprising the steps of:

(a) connecting in a drill string in a borehole, a tubular assembly including an axial through passage extending between an inlet and an outlet, and a radial port;

(b) dropping a first ball into the axial through passage to rest within the axial through passage against an upper ball retaining means, below the radial port, thereby preventing fluid flow between the inlet and the outlet of the axial through passage, causing fluid in the through passage to be directed through the radial port;

(c) dropping a second ball into the axial through passage to rest in the radial port and prevent fluid flow through the tool; and (d) by increased fluid pressure, moving the first ball in the through passage to rest against a lower ball retaining means, where the first ball again prevents fluid flow between the inlet and the outlet of the axial passage, the movement of the first ball causing a pressure differential sufficient to move a member, closing the radial port and thereby releasing the second ball into the through passage.

14. A method of circulating fluid in a borehole as claimed in claim 13 including the step of catching the first and second balls in a catching means at the bottom of the tool.

15. A method of circulating fluid in a borehole comprising the steps of:

(a) connecting a down hole tool, according to any one of claims 10 to 5, in a drill string suspended in the borehole;

(b) establishing fluid flow through the axial through passage of the tool;

(c) releasing the first ball means into the axial through passage to seat in the upper ball retaining means thereby obstructing the axial fluid flow through the tool;

(d) moving the obturating member by the increase of fluid pressure against the first ball means to locate the radial port with the second outlet thereby allowing fluid flow through the second outlet;

(e) releasing the second ball means from the surface, such that the second ball means locates in the radial port thereby obstructing the fluid flow through the second outlet;

(f) forcing the first ball means passed the upper ball retaining means by the increase in pressure so as to locate the first ball means in the lower ball retaining means, the first ball means falling a distance comparatively short enough to ensure sufficient pressure to move the obturating member back up the tubular assembly thereby closing the radial port and releasing the second ball means; and (g) allowing the fluid pressure to increase to a sufficient pressure to cause the first ball means to pass through the lower ball retaining means and the second ball means to follow therethrough and allow axial fluid flow to be re-established.

* * * * *